US011284757B2

(12) United States Patent
Ni

(10) Patent No.: US 11,284,757 B2
(45) Date of Patent: Mar. 29, 2022

(54) HANDHELD WINDOW CLEANING MACHINE HAVING WASTEWATER SEPARATION STRUCTURE

(71) Applicant: KINGCLEAN ELECTRIC GREEN TECHNOLOGY (SUZHOU) CO., LTD., Suzhou (CN)

(72) Inventor: Zugen Ni, Suzhou (CN)

(73) Assignee: KINGOLEAN ELECTRIC GREEN TECHNOLOGY (SUZHOU) CO., LTD., Suzhou (CN)

( * ) Notice: Subject to any disclaimer, the term of this patent is extended or adjusted under 35 U.S.C. 154(b) by 621 days.

(21) Appl. No.: 16/328,564

(22) PCT Filed: May 27, 2017

(86) PCT No.: PCT/CN2017/086245
§ 371 (c)(1),
(2) Date: Feb. 26, 2019

(87) PCT Pub. No.: WO2018/094995
PCT Pub. Date: May 31, 2018

(65) Prior Publication Data

US 2019/0343346 A1 Nov. 14, 2019

(30) Foreign Application Priority Data

Nov. 24, 2016 (CN) ..... 201621272038.5

(51) Int. Cl.
*A47L 1/05* (2006.01)
*A47L 1/08* (2006.01)
*A47L 7/00* (2006.01)

(52) U.S. Cl.
CPC *A47L 1/05* (2013.01); *A47L 1/08* (2013.01); *A47L 7/0019* (2013.01); *A47L 7/0033* (2013.01)

(58) Field of Classification Search
CPC . A47L 1/05; A47L 1/08; A47L 7/0019; A47L 7/0033; A47L 7/0023; A47L 11/33;
(Continued)

(56) References Cited

FOREIGN PATENT DOCUMENTS

CN 203898195 U * 10/2014
CN 104398211 A 3/2015
(Continued)

OTHER PUBLICATIONS

Translation of CN203898195U, retrieved from Espacenet on Nov. 22, 2021 (Year: 2014).*
(Continued)

*Primary Examiner* — Orlando E Aviles
*Assistant Examiner* — Thomas Raymond Rodgers
(74) *Attorney, Agent, or Firm* — Maschoff Brennan

(57) ABSTRACT

A handheld window cleaning machine includes a shell assembly in which a water-air separation unit is accommodated; a water tank assembly at a bottom of the shell assembly, a wastewater separation unit in the water tank assembly, an outlet of the wastewater separation unit in communication with an inlet of the water-air separation unit; and a suction nozzle assembly pluggably connected to a front end of the shell assembly, an outlet of the suction nozzle assembly in communication with the wastewater separation unit; an air outlet of the water-air separation unit is open outward, and a wastewater backflow opening at a bottom of the water-air separation unit, and the wastewater backflow opening in communication with an inlet of the wastewater separation unit. The cleaning efficiency of the window cleaning machine is ensured, and wastewater is effectively separated from air.

9 Claims, 8 Drawing Sheets

(58) Field of Classification Search
CPC ..... A47L 11/34; A47L 11/38; A47L 11/4022; A47L 11/4027; A47L 11/4088; A47L 9/06
USPC ..... 15/401
See application file for complete search history.

(56) References Cited

FOREIGN PATENT DOCUMENTS

| | | | |
|---|---|---|---|
| CN | 105078356 | A | 11/2015 |
| CN | 105078359 | A | 11/2015 |
| CN | 105105684 | A | 12/2015 |
| CN | 205006785 | A | 2/2016 |
| CN | 205006788 | U | 2/2016 |
| CN | 205144437 | U | 4/2016 |
| GB | 2030849 | B | 4/1980 |

OTHER PUBLICATIONS

International Search Report and Written Opinion dated Aug. 25, 2017, in related PCT Application No. PCT/CN2017/086245 (16 pages).

* cited by examiner

HANDHELD WINDOW CLEANING MACHINE HAVING WASTEWATER SEPARATION STRUCTURE

The present application is the national phase of International Application No. PCT/CN2017/086245, titled "HANDHELD WINDOW CLEANING MACHINE HAVING WASTEWATER SEPARATION STRUCTURE", filed on May 27, 2017, which claims the priority to Chinese Patent Application No. 201621272038.8, titled "HANDHELD WINDOW CLEANING MACHINE HAVING WASTEWATER SEPARATION STRUCTURE", filed with the National Intellectual Property Administration, PRC on Nov. 24, 2016, which are incorporated herein by reference in their entirety.

FIELD

The present application relates to the technical field of household window cleaning machine, and more specifically to a handheld window cleaning machine having a wastewater separation structure.

BACKGROUND

Many commercial buildings now have more than twenty or thirty floors, and peripheries of the commercial buildings are surrounded by glass windows. These buildings look very tall and classy. However, sanitation of the outside glass windows of the buildings is a problem. At present, a conventional cleaning window method in the market is mainly through hanging a suspension device on external walls of the buildings, and window cleaning workers in the suspension device do a high-altitude operation to complete window cleaning work. This high-altitude window cleaning has too large volume, there is a great danger, the efficiency of cleaning is affected because cleaners are nervous in their mind, and ordinary families cannot afford the window cleaning services. In addition, the high-altitude operation is dangerous and insecure, it is inconvenient to replace cleaning water, and the window cleaning efficiency is low. Therefore, how to design a device to perform a high-altitude operation instead of cleaners is a research topic nowadays. Now some devices have been developed to replace the manual work, such as a window cleaning machine, which is mainly used for cleaning the windows and external walls of buildings.

At present, the wastewater treatment capability of a conventional window cleaning machine is insufficient, resulting in that wastewater cannot be effectively separated from air. During the using process, the output air often carries unseparated wastewater droplets, resulting in water spraying phenomenon, and limiting the user experience, so that the promotion and application of the window cleaning machine has certain limitations. The wastewater sprayed out may also pollute the cleaned glass again, resulting in poor cleaning effect.

SUMMARY

In view of the shortcomings existing in the above technology, an object of the present application is to provide a handheld window cleaning machine having a wastewater separation structure, to optimize and improve an existing window cleaning machine, to ensure that the cleaning efficiency of the window cleaning machine can be improved at the same time, to improve the wastewater collection capability of the window cleaning machine, and to effectively separate wastewater from air, thereby resolving the technical problem of being easy to spray water by the window cleaning machine.

In order to realize these objects and other advantages according to the present application, a handheld window cleaning machine having a wastewater separation structure is provided, including: a shell assembly in which a water-air separation unit is accommodated; a water tank assembly provided at a bottom of the shell assembly, a wastewater separation unit being provided in the water tank assembly, an outlet of the wastewater separation unit being in communication with an inlet of the water-air separation unit; and a suction nozzle assembly pluggably connected to a front end of the shell assembly, an outlet of the suction nozzle assembly being in communication with the wastewater separation unit; wherein an air outlet of the water-air separation unit is open outward, and a wastewater backflow opening is provided at a bottom of the water-air separation unit, and the wastewater backflow opening is in communication with an inlet of the wastewater separation unit.

Preferably, a groove sunken inward is provided at a lower portion of the shell assembly, an accommodation chamber is provided in a front portion of the groove, the water tank assembly is pluggably inserted into the groove, and the water-air separation unit is arranged in the accommodation chamber.

Preferably, the water-air separation unit includes a water-air separation body, a motor cover plate, a centrifugal fan and a motor, the motor cover plate is sealed and connected with the water-air separation body to form a fan chamber for accommodating the centrifugal fan, a closed motor chamber and an auxiliary water tank transversely running through the water-air separation body are provided in the water-air separation body, the motor chamber is adjacent to the auxiliary water tank, at least one through hole in communication with the auxiliary water tank is provided at a bottom of the fan chamber close to a side wall of the fan chamber, and the motor is sealed and arranged in the motor chamber and is connected with the centrifugal fan arranged in the fan chamber.

Preferably, grid-shaped air outlets are symmetrically provided on two sides of the accommodation chamber, the groove is separated from the accommodation chamber by a partition plate, an air evacuation opening and a water inlet are provided in the partition plate, the air evacuation opening is higher than the water inlet, the auxiliary water tank is closed by an auxiliary water tank cover with an air outlet to form the auxiliary water tank, and the air outlet is aligned with the grid-shaped air outlets.

Preferably, the suction nozzle assembly includes a suction nozzle upper cover, a suction nozzle and a suction nozzle lower cover, which are arranged sequentially from top to bottom to form a sandwich structure, a suction nozzle lock buckle is arranged in a center of an upper end of the suction nozzle upper cover, a first wastewater outlet is arranged on a bottom of an inner side of the suction nozzle lower cover; the suction nozzle includes suction nozzle cover plates which are covered up and down together to form a converging cavity and a suction nozzle lower cover rubber coating, a front end of the suction nozzle lower cover rubber coating is led from the suction nozzle assembly, a suction nozzle strip is arranged on an led-out end, a wastewater suction opening of the suction nozzle assembly is formed between the led-out end and the suction nozzle strip, and a bottom of an inner side of the converging cavity is in communication with the first wastewater outlet.

Preferably, the water tank assembly includes: a tank with a hollow interior fitted with the groove, the tank is made of transparent material with a certain structural strength, a wastewater discharging opening is provided at a bottom of the tank, the wastewater separation unit is arranged in the tank; and the wastewater separation unit includes: an air-out pipe, a water inlet pipe and a water-air separation plate, a front end of the water inlet pipe is fixedly connected with a front end of the tank, a front end of the air-out pipe is fixedly connected with an upper end of the tank.

Preferably, the water inlet pipe is obliquely upward inserted in the tank, the front end of the water inlet pipe is lower than a rear end thereof, the air-out pipe is obliquely downward insertion in the tank, the front end of the air-out pipe is higher than a rear end thereof, and the rear end of the air-out pipe is lower than the rear end of the water inlet pipe, a water-air separation plate is arranged at a side of the rear end of the air-out pipe close to the rear end of the water inlet pipe, there is a certain clearance between a left side of the water-air separation plate and an inner side of the tank and between a right side of the water-air separation plate and the inner side of the tank, and a bottom end of the water-air separation plate is lower than the lowest position of the rear end of the air-out pipe.

Preferably, a suction nozzle joint is fixedly provided at a front side of the water-air separation body, a lock buckle hole is arranged at a front end of the suction nozzle joint, the suction nozzle assembly is connected in the lock buckle hole through the suction nozzle lock buckle, and a second wastewater outlet is arranged on a bottom of an inner side of the suction nozzle joint, and the first wastewater outlet is butted with the second wastewater outlet.

Preferably, a water entry passage is isolated from a lower portion of the auxiliary water tank, the wastewater backflow openings are arranged at a bottom of the auxiliary water tank, the water entry passage is in communication with the auxiliary water tank through the wastewater backflow openings, the suction nozzle joint is in communication with the water entry passage through a suction nozzle elbow pipe, the front end of the water inlet pipe is in communication with the water entry passage, after being sucked by the suction head assembly, wastewater flows into the tank through the suction nozzle joint, the suction nozzle elbow pipe, the water entry passage and the water inlet pipe in sequence.

Preferably, an air-out connecting port in communication with the fan chamber is arranged behind the motor cover plate, the front end of the air-out pipe is in communication with the air-out connecting port through the air evacuation opening, the front end of the water inlet pipe is in communication with the water entry passage through the water inlet, the centrifugal fan is configured to throw a water-air mixture outputted from the air-out pipe onto a side wall of the fan chamber.

Compared with the conventional technology, beneficial effects of the present application are:

1. The suction nozzle assembly is connected with the front end of the shell assembly through the suction nozzle lock buckle, and the suction nozzle assembly is composed of a detachable structure for easy installation, disassembly and cleaning, the suction nozzle is composed of a suction nozzle cover plate and a suction nozzle lower cover rubber coating, a suction nozzle strip wastewater suction opening is arranged at a front end of the suction nozzle lower cover rubber coating, which increases a suction wastewater area and improves the area of a single window cleaning of the window cleaning machine.

2. A wastewater separation unit is arranged in the water tank assembly, after the wastewater enters the water tank assembly through the suction nozzle assembly, a preliminary separation of wastewater and air is realized. After entering the water inlet pipe, the water-air mixture is blocked by the water-air separation plate, and the wastewater condenses from the water-air separation plate and then collects to the bottom of the tank. At the same time, a bottom end of the water-air separation plate is lower than the lowest position of the rear end of the air-out pipe, so that the wastewater will not be sucked out of the air-out pipe, thereby avoiding the occurrence of water spraying phenomenon.

3. A water-air separation unit is accommodated in a shell assembly, the water-air mixture treated by the wastewater separation unit is further separated by the water-air separation unit, the wastewater in the air and air are separated by the centrifugal fan. After being collected, the wastewater backflows into the water inlet pipe. The air after the wastewater separation is discharged out of the window cleaning machine, thereby avoiding the water spraying phenomenon of the window cleaning machine.

Other advantages, objects and characteristics will be partly demonstrated hereinafter, and a part of the present application will also be understood by those skilled in the field through a research and practice of the present application.

DETAILED DESCRIPTION OF EMBODIMENTS

Figure 1:
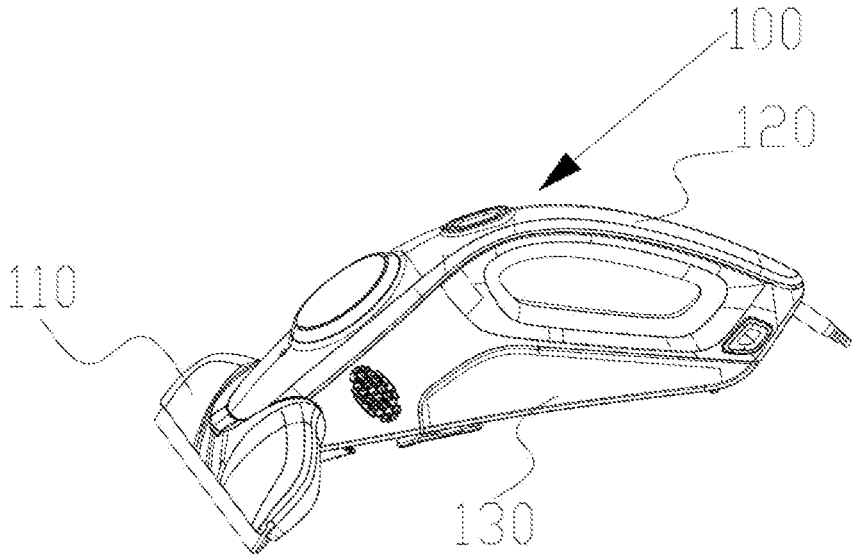
FIG. 1 is a three-dimensional view of an embodiment of a handheld window cleaning machine having a wastewater separation structure of the present application.

The present application will be further described in detail hereinafter in conjunction with the accompanying drawings, and the foregoing and other objects, characteristics, aspects and advantages of the present application will become more apparent, to enable a technical personnel in the field to implement the present application with reference to the instructions.

Referring to FIGS. 1 to 15, a handheld window cleaning machine having a wastewater separation structure 100 includes: a suction nozzle assembly 110, a shell assembly 120 and a water tank assembly 130.

The shell assembly 120 has a certain internal space, the shell assemble 120 includes a left shell 121, a right shell 122 and an upper shell 123. The shell assembly 120 has an arc-shaped arch structure, a switch assembly is arranged close to the highest point of the arc-shaped arch structure of the shell assembly 120, a cavity running through the arc-shaped arch structure of the shell assembly is formed at a rear half section of the arc-shaped arch structure of the shell assembly, so that a handle for easy holding is formed. A groove 126 sinking inward is provided in a lower portion of the shell assembly 120, and an accommodation chamber 127 is provided at a front portion of the groove 126, and a water-air separation unit 140 is accommodated in the accommodation chamber 127. The water-air separation unit 140 is used to separate the wastewater and air preliminarily.

A water tank assembly 130 is arranged at the bottom of the shell assembly 120 for collecting wastewater. Specifically, the water tank assembly 130 is pluggably embedded into the groove 126. A wastewater separation unit is arranged in the water tank assembly, and an outlet of the wastewater separation unit is in communication with an inlet of the water-air separation unit 140. Specifically, the water tank assembly includes: a tank 131 with a hollow interior fitted with the groove 126, wherein, the tank 131 is made of transparent material with a certain structural strength to display a wastewater level, and a wastewater discharging opening is provided at a bottom of the tank for discharging the wastewater in the tank. The wastewater separation unit is arranged in the tank 131. The wastewater separation unit includes: a air-out pipe 132, a water inlet pipe 133 and a water-air separation plate 132*a*. A front end of the water inlet pipe 133 is fixedly connected with a front end of the tank, and a front end of the air-out pipe is fixedly connected with an upper end of the tank. A central axis of the air-out pipe 132 and a central axis of the water inlet pipe 133 are coplanar with a central axis of the tank 131, and there is a certain clearance between the air-out pipe and an inner side of the tank 131 and between the water inlet pipe 133 and the inner side of the tank 131. The water inlet pipe 133 is obliquely upward inserted in the tank, with the front end of the water inlet pipe being lower than a rear end thereof. The air-out pipe 132 is obliquely downward inserted in the tank, with the front end of the air-out pipe being higher than a rear end thereof, and the rear end of the air-out pipe is lower than the rear end of the water inlet pipe. The water-air separation plate 132*a* is arranged at a side of the rear end of the air-out pipe close to the rear end of the water inlet pipe 133. There is a certain clearance between a left side of the water-air separation plate 132*a* and the inner side of the tank 131 and between a right side of the water-air separation plate 132*a* and the inner side of the tank 131. A bottom end of the water-air separation plate 132*a* is lower than the lowest position of the rear end of the air-out pipe, so that after being blocked by the water-air separation plate 132*a* at an outlet of the rear end of the water inlet pipe 133, the wastewater sucked by the water inlet pipe 133 is separated, the wastewater may not be directly extracted by the air-out pipe 132, thus realizing a preliminary water-air separation. The wastewater is gathered in the tank, the air after the preliminary water-air separation enters the air-out pipe through a bottom of the air-out pipe, and an outlet of the air-out pipe 132 is in communication with an inlet of the water-air separation unit 140.

A suction nozzle assembly 110 is pluggably connected to the front end of the shell assembly 120, and the suction nozzle assembly 110 is connected with the shell assembly 120 to form a T-shaped structure. An outlet of the suction nozzle assembly is in communication with the wastewater separation unit. Specifically, a wastewater outlet of the suction nozzle assembly 110 is in communication with the front end of the water inlet pipe 133. The wastewater on the glass is sucked into the water tank assembly 130; after a preliminary water-air separation in the wastewater separation unit, the wastewater is sucked into the water-air separation unit 140 for a further water-air separation.

Figure 14:
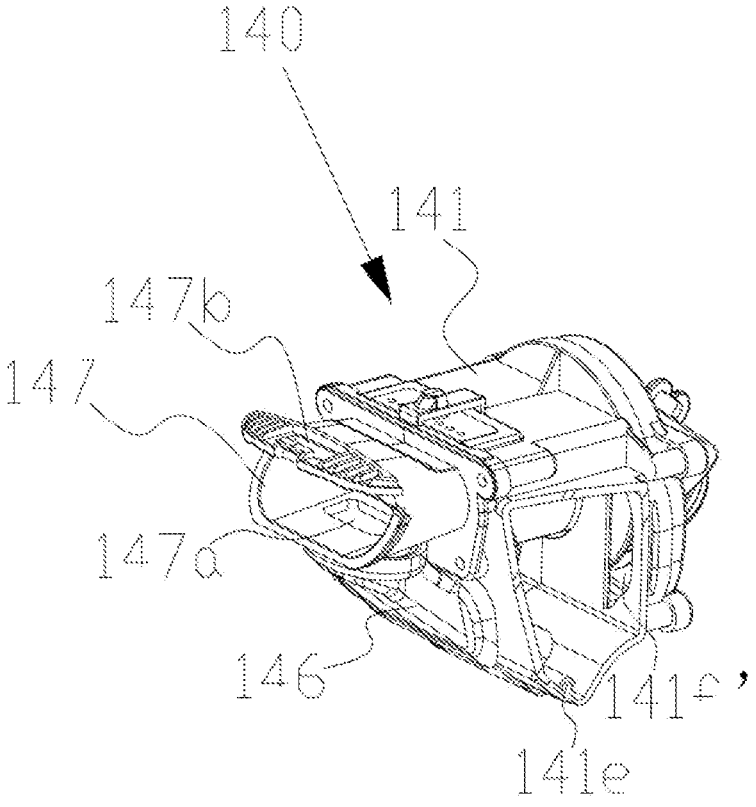
FIG. 14 is a front view of a water-air separation unit.
Figure 15:
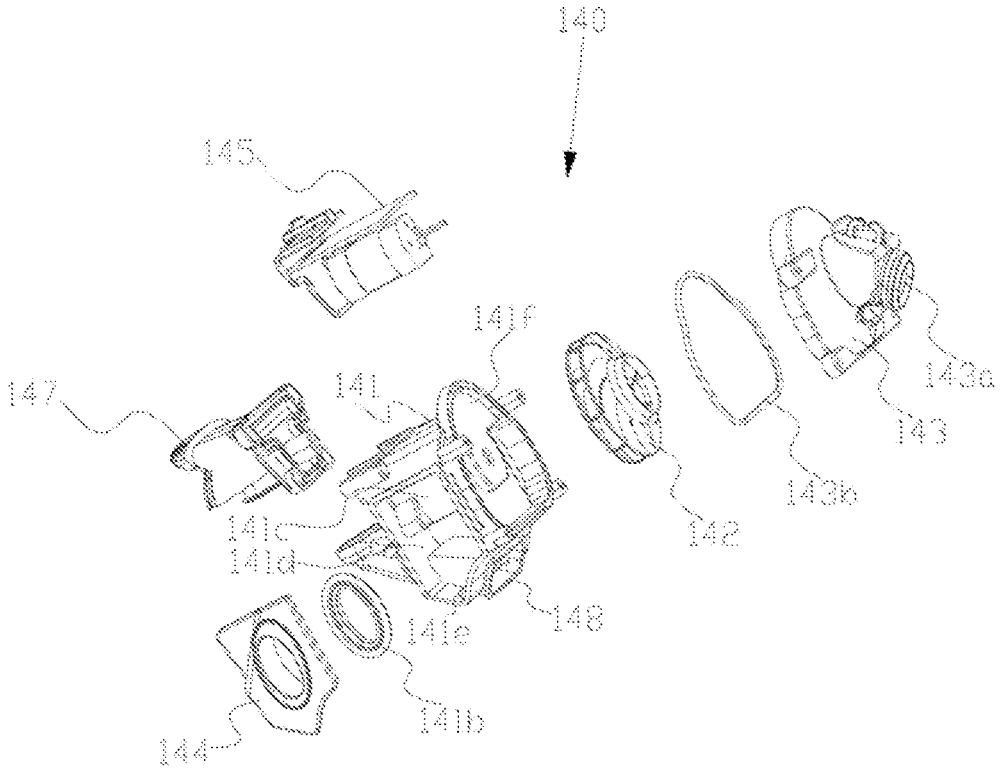
FIG. 15 is an explosion view of a water-air separation unit.

As shown in FIGS. 14 to 15, the water-air separation unit 140 includes a water-air separation body 141, a motor cover plate 143, a centrifugal fan 142 and a motor 145. The motor cover plate 143 is sealed with the water-air separation body 141 to form a fan chamber 141*f* for accommodating the centrifugal fan 142. A closed motor chamber 141*c* and an auxiliary water tank 141*d* running through the water-air separation body 141 are provided in the water-air separation body 141. The motor chamber 141*c* is adjacent to the auxiliary water tank 141*d*, the motor 145 is sealed and arranged in the motor chamber 141*c* and is connected with the centrifugal fan arranged in the fan chamber. The centrifugal fan is configured to throw water-air mixture outputted from the air-out pipe onto a side wall of the fan chamber. The motor 145 drives the centrifugal fan to rotate, to separate the water from the air with droplets outputted from the wastewater separation unit again. The auxiliary water tank 141*d* is closed by an auxiliary water tank cover 144 with an air outlet, thereby forming the auxiliary water tank. In one embodiment, a sealing ring 141*b* is arranged between the auxiliary water tank cover 144 and the water-air separation body 141. In another embodiment, a sealing ring 143*b* is arranged between the motor cover plate 143 and the water-air separation body 141, and an air-out connecting port 143*a* in communication with the front end of the air-out pipe 132 is arranged at an upper surface of the motor cover plate 143. At least one through hole 141*r* in communication with the auxiliary water tank is provided at a bottom of the fan chamber 141*f* close to a side wall of the fan chamber. In the present embodiment, two through holes 141*f'* are provided symmetrically, and the two through holes 141*f* are symmetrically arranged about a central axis of the water-air separation body 141. An air outlet of the water-air separation unit 140 is open outward, an air outlet on the auxiliary water tank cover 144 is aligned with the air outlet, and the air separated from the water-air separation unit is discharged out of the machine. A wastewater backflow opening 141*e* is provided at the bottom of the water-air separation unit, the wastewater backflow opening is in communication with the inlet of the wastewater separation unit, the wastewater separated by the water-air separation unit backflows and collects into the tank, to avoid being directly discharged outward, thereby solving the water spraying problem of the window cleaning machine.

Figure 2:
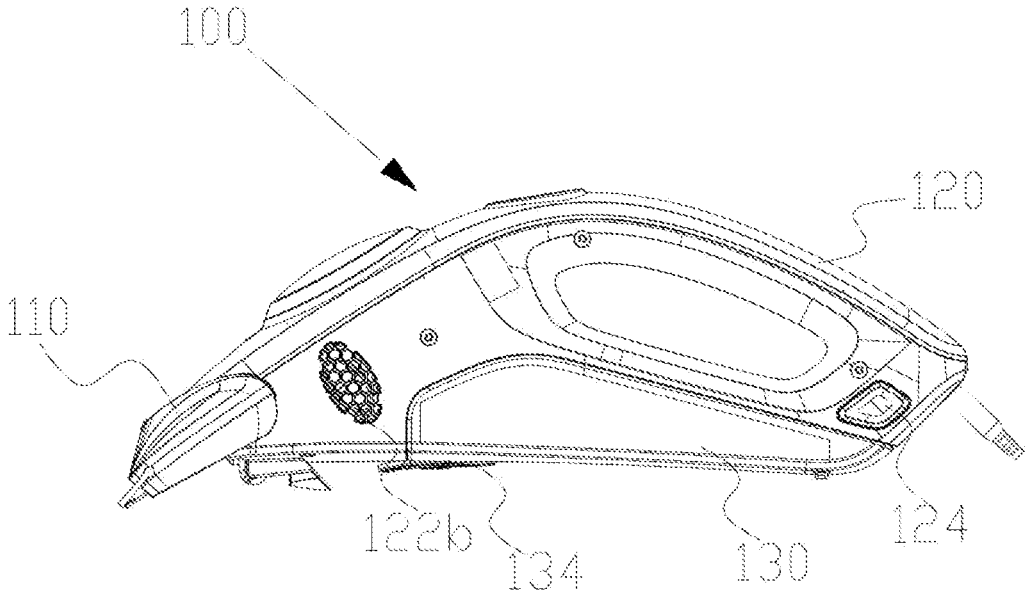
FIG. 2 is a side view of FIG. 1.
Figure 4:
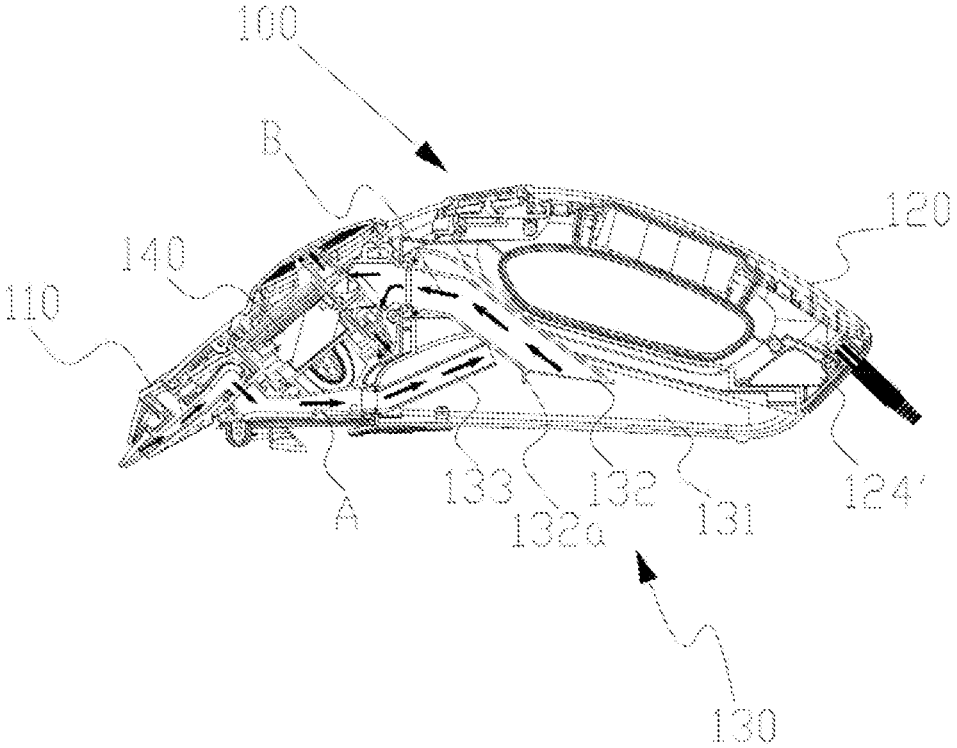
FIG. 4 is a sectional view of FIG. 1.

As shown in FIGS. 2 and 4, a tank connection portion is integrally provided at a rear end of the water tank assembly 130, and connection grooves are symmetrically provided at the left and right sides of the tank connection portion. A clamping groove 124' fitted with the tank connection portion is provided at a rear end of the shell assembly 120, a tank lock buckle 124 selectively clamped with the connection groove is provided in the clamping groove 124', thus the water tank assembly 130 can be selectively pluggably connected with the shell assembly 120 to make the user to remove and wash the water tank assembly 130 conveniently.

Figure 3:
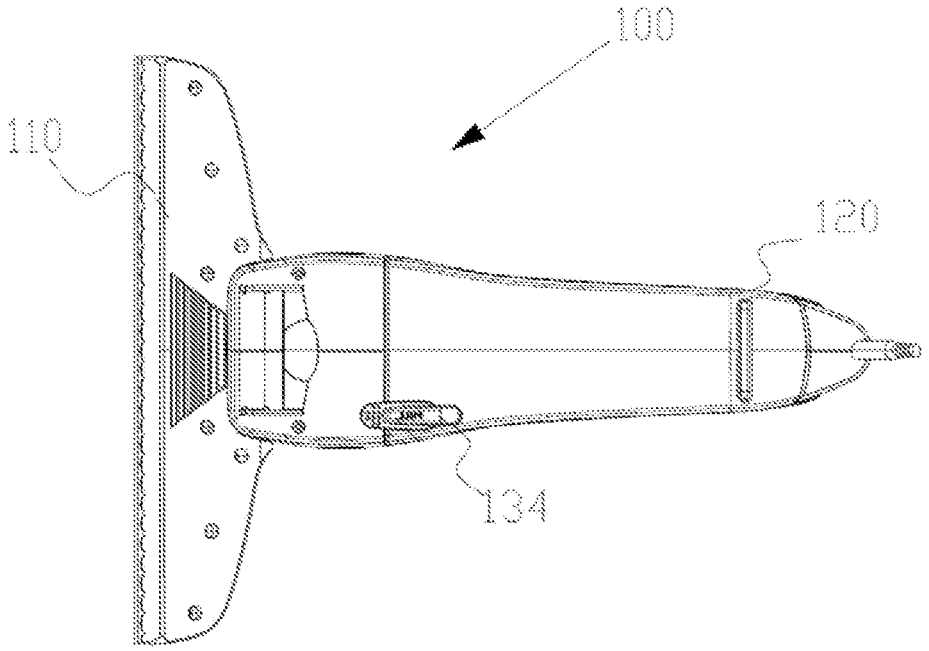
FIG. 3 is a top view of FIG. 1.

As shown in FIG. 3, a wastewater discharging opening is provided at the bottom of the tank 131, and the wastewater discharging opening is closed by a pluggable sealing plug 134 in the working process. When a window cleaning is completed and drainage is needed, the sealing plug 134 may be pulled out to discharge the wastewater in the tank 131, and after discharging the wastewater, the sealing plug 134 is inserted again to close the tank, waiting for the next cleaning.

Figure 8:
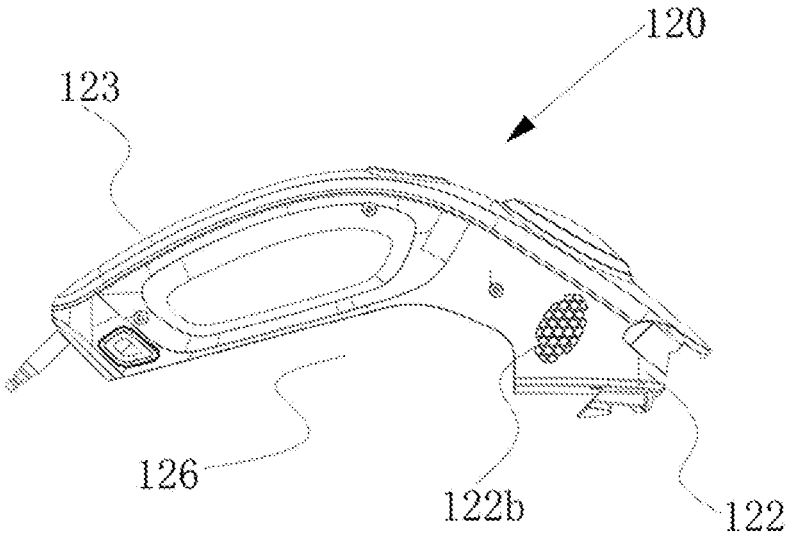
FIG. 8 is a side view of a shell assembly.
Figure 9:
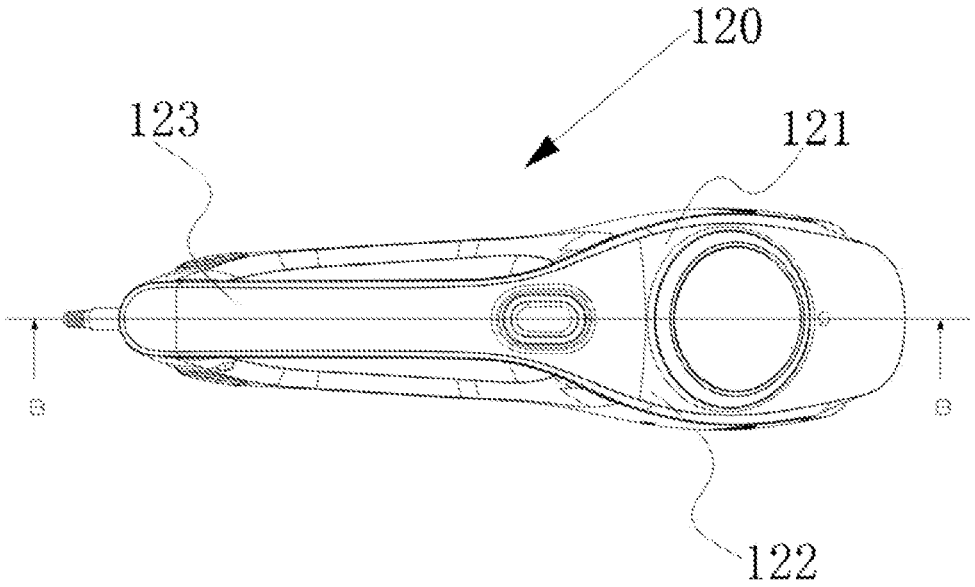
FIG. 9 is a top view of the shell assembly.
Figure 10:
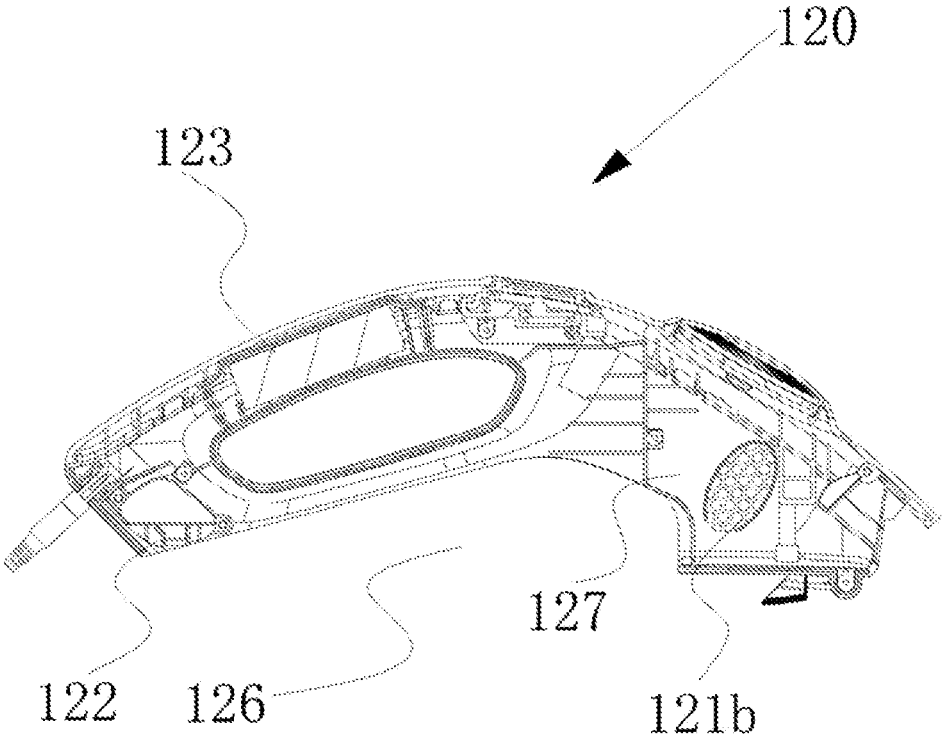
FIG. 10 is a sectional view of the shell assembly.
Figure 11:
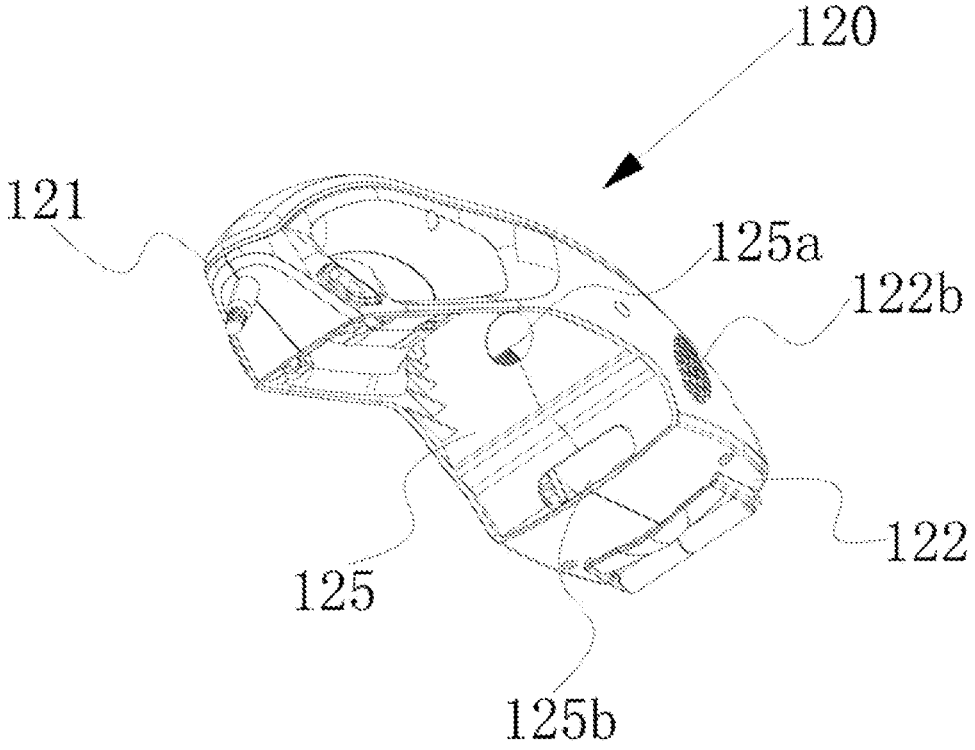
FIG. 11 is a schematic structural view of a bottom portion of the shell assembly.
Figure 12:
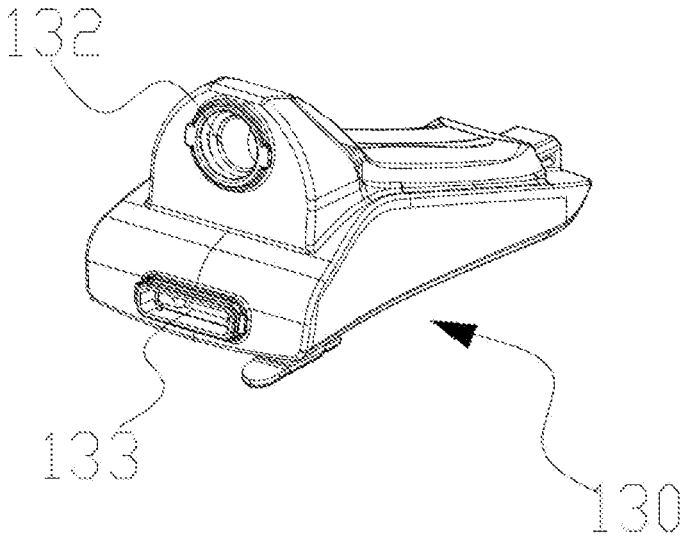
FIG. 12 is a three-dimensional structural view of a water tank assembly.
Figure 13:
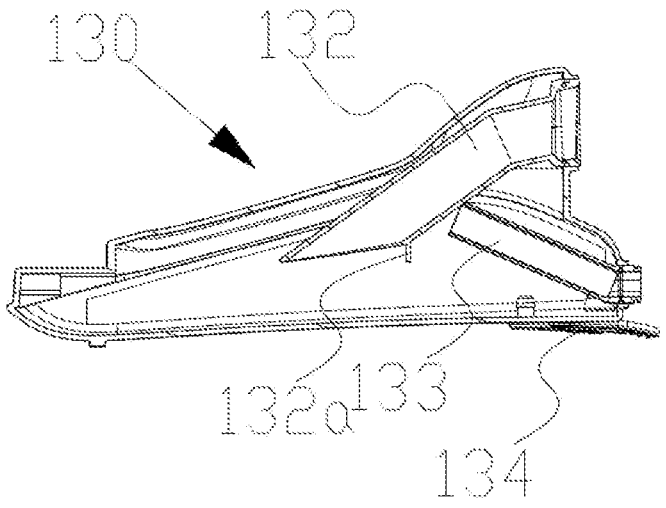
FIG. 13 is a sectional view of a water tank assembly.

As shown in FIGS. 8 and 10, grid-shaped air outlets 121*b* and 122*b* are symmetrically provided on two sides of the accommodation chamber 127, the groove 126 is separated from the accommodation chamber 127 by a partition plate 125, and an air evacuation opening 125*a* and a water inlet 125*b* are provided in the partition plate 125. The air evacuation opening 125*a* is higher than the water inlet 125*b*, the front end of the air-out pipe 132 passing through the air evacuation opening is in communication with the air evacuation opening 125*a*, and the front end of the water inlet pipe 133 passing through the water inlet is communication with the water inlet 125*b*.

As shown in FIGS. 14 and 15, a water entry passage 148 is isolated from a lower portion of the auxiliary water tank 141*d*, the wastewater backflow opening 141*e* is arranged at a bottom of the auxiliary water tank. In the present embodiment, two wastewater backflow openings 141*e* are symmetrically arranged at two ends of the bottom of the auxiliary water tank, and the wastewater backflow openings run through two sides of the water entry passage 148. The water entry passage is in communication with the auxiliary water tank via the wastewater backflow openings, and the water entry passage 148 is in communication with the suction nozzle 110 and the water tank assembly 130.

A suction nozzle joint 147 is fixedly provided at a front side of the water-air separation body 141, and the suction nozzle joint is in communication with the water entry passage 148 through a suction nozzle elbow pipe 146. The front end of the water inlet pipe is in communication with the water entry passage. After being sucked by the suction head assembly, the wastewater flows into the tank after passing through the suction nozzle joint, the suction nozzle elbow pipe, the water entry passages and the water inlet pipe in sequence. The front end of the air-out pipe 132 is in communication with the air-out connecting port 143*a*.

Figure 5:
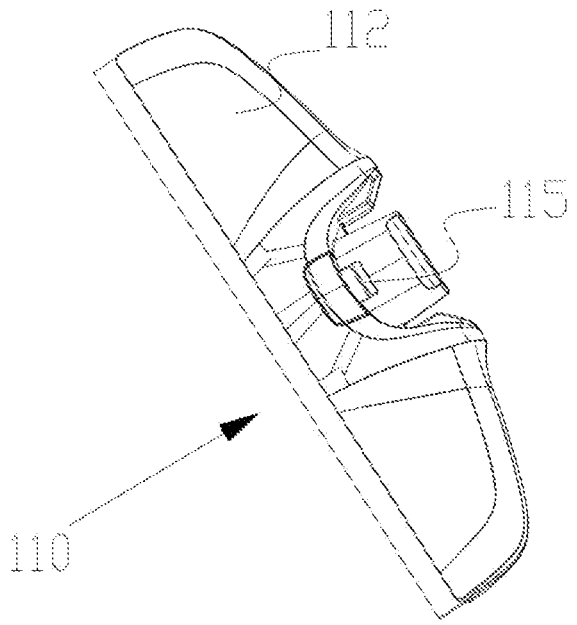
FIG. 5 is a schematic view of a top portion of a suction nozzle assembly.
Figure 6:
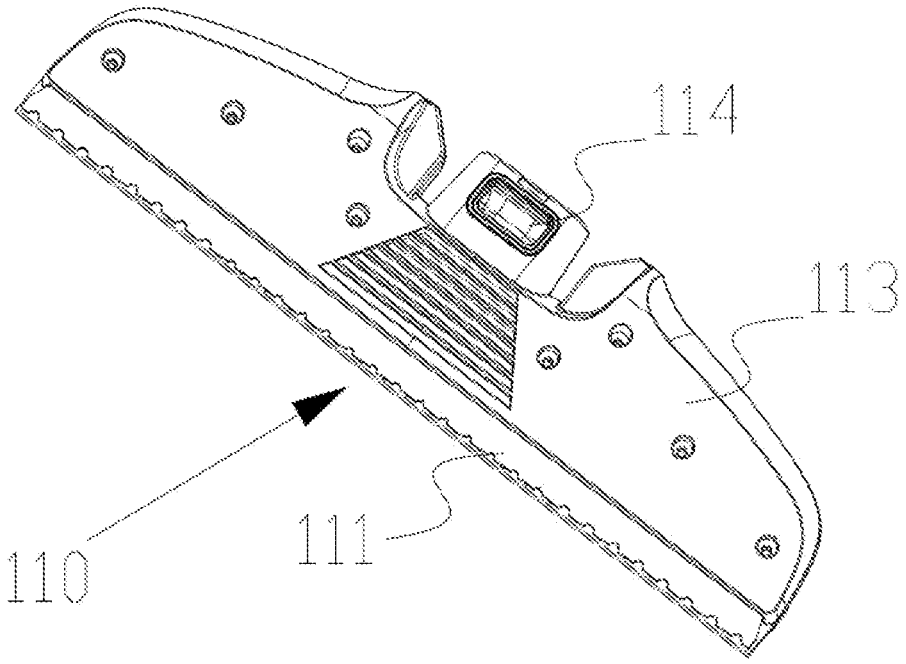
FIG. 6 is a schematic view of a bottom portion of the suction nozzle assembly.
Figure 7:
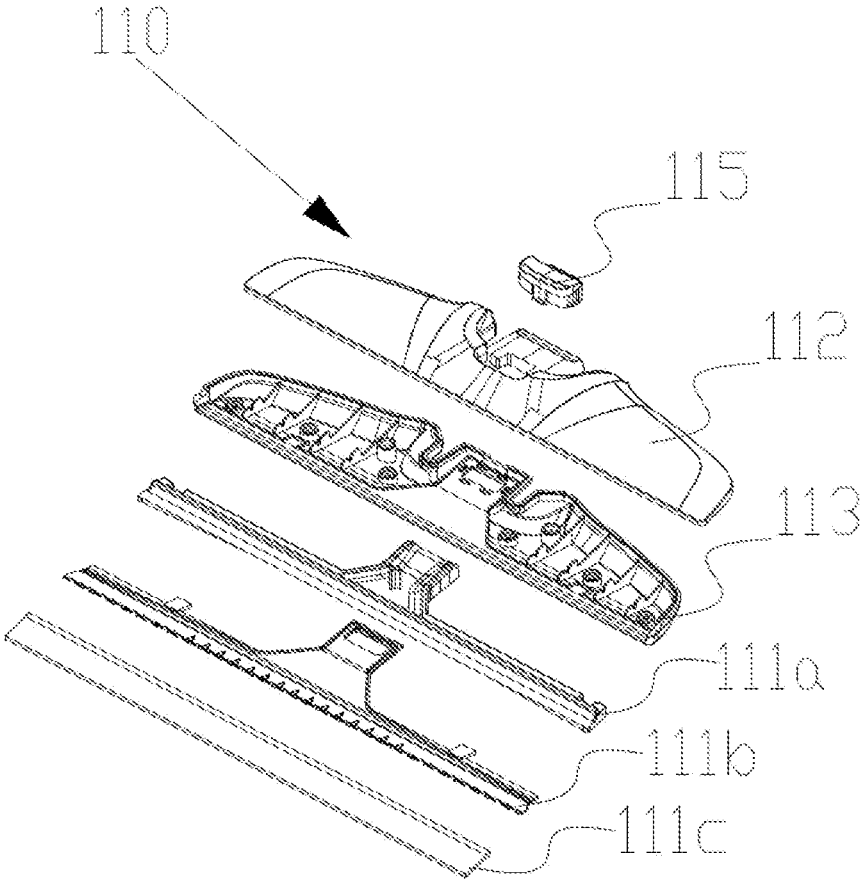
FIG. 7 is an explosion view of the suction nozzle assembly.

As shown in FIGS. 5 to 7, the suction nozzle assembly 110 includes a suction nozzle upper cover 112, a suction nozzle 111 and a suction nozzle lower cover 113, which are arranged sequentially from top to bottom into a sandwich structure. A suction nozzle lock buckle 115 is arranged at a center of an upper end of the suction nozzle upper cover, and a lock buckle hole 147*b* is arranged in a front end of the suction nozzle joint. The suction nozzle assembly 110 is connected in the lock buckle hole 147*b* through the suction nozzle lock buckle 115. The suction nozzle assembly is connected at the front end of the shell assembly through the suction nozzle lock buckle, and the suction nozzle assembly is composed of a detachable structure for easy installation, disassembly and cleaning. A first wastewater outlet 114 is arranged on a bottom of an inner side of the suction nozzle lower cover. The suction nozzle 111 includes suction nozzle cover plates 111*a* which are covered up and down together to form a converging cavity and a suction nozzle lower cover rubber coating 111*b*. A front end of the suction nozzle lower cover rubber coating is led out through the suction nozzle assembly, and a suction nozzle strip 111*c* is arranged on a led-out end. A wastewater suction opening of the suction nozzle assembly is formed between the led-out end and the suction nozzle strip, to increase a wastewater suction area each time and improve the window cleaning efficiency. A bottom of an inner side of the converging cavity is in communication with the first wastewater outlet 114, and a second wastewater outlet 147*a* is arranged on a bottom of an inner side of the suction nozzle joint 147, and the first wastewater outlet is butted with and in communication with the second wastewater outlet.

A working process of the window cleaning machine is as follows:

The user holds the handheld window cleaning machine having a wastewater separation structure 100, attaches the suction nozzle assembly 110 onto a contaminative surface to be cleaned where a detergent is sprayed or wastewater remains, and then presses a switch button, and then the handheld window cleaning machine having a wastewater separation structure 100 starts to work. Under the action of the centrifugal fan 142 in the water-air separation unit 140, the tank 131 is vacuumed through the air-out pipe 132, so that the wastewater at the contaminative surface to be cleaned together with the air is sucked into the tank 131 after passing through the wastewater suction opening in the suction nozzle assembly, the first wastewater outlet 114, the second wastewater outlet 147*a*, the suction nozzle elbow pipe 146, the water entry passage 148 and the water inlet pipe 133 in sequence, that is, a wastewater flow direction indicated by A in FIG. 4. After a preliminary wastewater separation by the wastewater separation unit, the water-air mixture enters the water inlet pipe and is blocked by the water-air separation plate, and the wastewater condenses from the water-air separation plate and collects to the bottom of the tank. At the same time, the bottom end of the water-air separation plate is lower than the lowest position of the rear end of the air-out pipe, so that the wastewater cannot be sucked out by the air-out pipe, thereby avoiding the occurrence of water spraying phenomenon. Specifically, the wastewater carried in the air may not be sucked away by the air-out pipe 132 under the action of the water-air separation plate 132*a*; instead, the wastewater may condense at a surface of the water-air separation plate 132*a* and then collects to the bottom of the tank 131 along the surface of the water-air separation plate 132*a*. If a little wastewater is drawn away by the air-out pipe 132 together with the air, the wastewater enters into the water-air separation unit 140 for a further wastewater separation, as shown by a flow direction indicated by B in FIG. 4. The wastewater in the air and the air are separated by the centrifugal fan, the wastewater after collecting backflows into the water inlet pipe, and the air after wastewater separation is discharged out of the window cleaning machine, thereby avoiding the water spraying phenomenon of the window cleaning machine. Specifically, the air after separation is discharged outward through the air outlet, the wastewater after separation passes through the through hole 141*r* and the wastewater backflow opening 141*e* in sequence and then converges with the newly wastewater drawn into the water inlet pipe 148, and backflows into the tank again through the water inlet pipe 133 together. After two times of wastewater separation, the wastewater is separated from the air, and there are basically no wastewater droplets in the finally discharged air, thereby avoiding the water spraying phenomenon of the window cleaning machine, and also avoiding the occurrence of water spraying phenomenon caused by improper operation or when the tank collecting the wastewater is to be full.

As described above, because the suction nozzle assembly 110 includes the suction nozzle upper cover 112, the suction nozzle 111 and the suction nozzle lower cover 113 which are covered up and down to form a sandwich structure, not only the suction nozzle assembly 110 is easy to be disassembled and cleaned, but also it is ensured that the suction nozzle assembly has the best structural strength under the simplest structural composition. The air-out pipe 132 and the water inlet pipe 133 are provided in the tank 131, so that the suction of the wastewater and the discharge of the air in the tank 131 are both reasonable and orderly, thus it is easy to separate the water from air, and overflow phenomenon and water spraying phenomenon may not happen. Because the tank 131 is made of the transparent material with a certain structural strength, it is easy for users to observe a wastewater amount in the tank on the premise of ensuring the structural strength of the tank 131, and when the collected wastewater amount reaches a certain level, the user can be reminded to discharge the wastewater in time. Because the central axis of the air-out pipe 132 and the central axis of the water inlet pipe 133 are coplanar with the central axis of the tank 131, and there are a certain clearances between the air-out pipe 132 and the inner side of the tank 131 and between the water inlet pipe 133 and the inner side of the tank 131, when the window cleaning machine leans left or right during the use of the window cleaning machine, the wastewater may not be sucked into the air-out pipe 132, thereby further avoiding the occurrence of water spraying phenomenon. Since the air-out pipe 132 is obliquely downward inserted in the tank 131, the water inlet pipe 133 is obliquely upward inserted in the tank 131, and the rear end of the air-out pipe 132 is higher than the rear end of the water inlet pipe 133, the wastewater may not be sucked out by the air-out pipe 132 after being sucked by the water inlet pipe 133, thereby avoiding the water spraying phenomenon. Because the water-air separation plate 132*a* is arranged at the side of the rear end of the air-out pipe 132 close to the rear end of the water inlet pipe 133, there are a certain clearances between the left side of the water-air separation plate 132*a* and the inner side of the tank 131 and between the right side of the water-air separation plate 132*a* and the inner side of the tank 131, and the bottom end of the water-air separation plate 132*a* is lower than the lowest position of the rear end of the air-out pipe 132, the wastewater may be separated by the water-air separation plate 132*a* after being sucked into the water inlet pipe 133, thereby further avoiding a large number of water-air mixture being sucked into the air-out pipe 132. The water entry passages 148 are arranged below the auxiliary water tank 141*d* at intervals, the water entry passages 148 are in communication with the suction nozzle assembly 110 and the water tank assembly 130, at least one wastewater backflow opening 141*e* is arranged between the water entry passage 148 and the auxiliary water tank 141*d*, and the water entry passages 148 are in communication with the auxiliary water tank 141 through the wastewater backflow opening 141*e*, thus allowing the separated wastewater to converge with the newly wastewater drawn into the water inlet pipe 148 through the wastewater backflow opening 141*e*, and backflows into the tank 131 again through the water inlet pipe 133 together, avoiding the occurrence of water spraying phenomenon caused by improper operation or when the tank 131 collecting the wastewater is to be full. Because the through hole 141*f'* in communication with the auxiliary water tank 141*d* is provided at the bottom of the fan chamber 141*f* close to the side wall of the fan chamber 141*f*, the water-air mixture sucked through the air-out pipe 132 is thrown onto a side wall of the fan chamber 141*f* after the centrifugal action of the centrifugal motor 142, the foggy water vapor condenses on the side wall of the fan chamber 141*f* and slides down into the auxiliary water tank 141*d* through the through hole 141*f'*, while the air enters the auxiliary water tank 141*d* through the through hole 141*f'* and is discharged out of the machine through the air outlet, thereby avoiding the water spraying phenomenon of the window cleaning machine. After the preliminary wastewater separation in the wastewater separation unit and the secondary wastewater separation by the water-air separation unit 140, the wastewater is gathered in the tank 131, and the dry air after the wastewater separation is discharged, thereby solving the technical problems of the window cleaning machine water spraying, improving the user experience and having a wide popularization value.

The technical solutions of the present application have been disclosed as above, however, the technical solutions of the present application are not limited to applications listed in the specification and the embodiments, it can be fully applied to various fields suitable for the present application, for those skilled familiar with the field, additional modifications may be easily implemented, therefore without departing from the general concept defined by the claims and the scope of equivalence, the present application is not limited to specific details and illustrations shown and described herein.

The invention claimed is:

1. A handheld window cleaning machine having a wastewater separation structure, comprising:

a shell assembly in which a water-air separation unit is accommodated;

a water tank assembly provided at a bottom of the shell assembly, a wastewater separation unit being provided in the water tank assembly, an outlet of the wastewater separation unit being in communication with an inlet of the water-air separation unit; and a suction nozzle assembly pluggably connected to a front end of the shell assembly, such that the suction nozzle assembly is rigidly connected to the shell assembly, an outlet of the suction nozzle assembly being in communication with the wastewater separation unit;

wherein an air outlet of the water-air separation unit is open outward, and a wastewater backflow opening is provided at a bottom of the water-air separation unit, and the wastewater backflow opening is in communication with an inlet of the wastewater separation unit wherein the water-air separation unit comprises a water-air separation body, a motor cover plate, a centrifugal fan and a motor, the motor cover plate is sealed and connected with the water-air separation body to form a fan chamber tor accommodating the centrifugal fan, a closed motor chamber and an auxiliary water tank transversely running through the water-air separation body are provided in the water-air separation body, the motor chamber is adjacent to the auxiliary water tank, at least one through hole in communication with the auxiliary water tank is provided at a bottom of the fan chamber close to a side wall of the fan chamber, and the motor is sealed and arranged in the motor chamber and is connected with the centrifugal fan arranged in the fan chamber.

2. The handheld window cleaning machine having the wastewater separation structure according to claim 1, wherein a groove sunken inward is provided at a lower portion of the shell assembly, an accommodation chamber is provided in a front portion of the groove, the water tank assembly is pluggably inserted into the groove, and the water-air separation unit is arranged in the accommodation chamber.

3. The handheld window cleaning machine having the wastewater separation structure according to claim 2, wherein grid-shaped air outlets are symmetrically provided on two sides of the accommodation chamber, the groove is separated from the accommodation chamber by a partition plate, an air evacuation opening and a water inlet are provided in the partition plate, the air evacuation opening is higher than the water inlet, the auxiliary water tank is closed by an auxiliary water tank cover with the air outlet to form the auxiliary water tank, and the air outlet is aligned with the grid-shaped air outlets.

4. The handheld window cleaning machine having the wastewater separation structure according to claim 3, wherein the suction nozzle assembly comprises a suction nozzle upper cover, a suction nozzle and a suction nozzle lower cover, which are arranged sequentially from top to bottom to form a sandwich structure, a suction nozzle lock buckle is arranged in a center of an upper end of the suction nozzle upper cover, a first wastewater outlet is arranged on a bottom of an inner side of the suction nozzle lower cover; and the suction nozzle comprises suction nozzle cover plates which are covered up and down together to form a converging cavity and a suction nozzle lower cover rubber coating, a front end of the suction nozzle lower cover rubber coating is led from the suction nozzle assembly, a suction nozzle strip is arranged on a led-out end, a wastewater suction opening of the suction nozzle assembly is formed between the led-out end and the suction nozzle strip, and a bottom of an inner side of the converging cavity is in communication with the first wastewater outlet.

5. The handheld window cleaning machine having the wastewater separation structure according to claim 4, wherein the water tank assembly comprises: a tank with a hollow interior fitted within the groove, the tank is made of transparent material with a certain structural strength, a wastewater discharging opening is provided at a bottom of the tank, the wastewater separation unit is arranged in the tank; and the wastewater separation unit comprises: an air-out pipe, a water inlet pipe and a water-air separation plate, a front end of the water inlet pipe is fixedly connected with a front end of the tank, a front end of the air-out pipe is fixedly connected with an upper end of the tank.

6. The handheld window cleaning machine having the wastewater separation structure according to claim 5, wherein the water inlet pipe is obliquely upward inserted in the tank, the front end of the water inlet pipe is lower than a rear end thereof, the air-out pipe is obliquely downward insertion in the tank, the front end of the air-out pipe is higher than a rear end thereof, and the rear end of the air-out pipe is lower than the rear end of the water inlet pipe, a water-air separation plate is arranged at a side of the rear end of the air-out pipe close to the rear end of the water inlet pipe, there is a certain clearance between a left side of the water-air separation plate and an inner side of the tank and between a right side of the water-air separation plate and the inner side of the tank, and a bottom end of the water-air separation plate is lower than the lowest position of the rear end of the air-out pipe.

7. The handheld window cleaning machine having the wastewater separation structure according to claim 6, wherein a suction nozzle joint is fixedly provided at a front side of the water-air separation body, a lock buckle hole is arranged at a front end of the suction nozzle joint, the suction nozzle assembly is connected in the lock buckle hole through the suction nozzle lock buckle, and a second wastewater outlet is arranged on a bottom of an inner side of the suction nozzle joint, and the first wastewater outlet is butted with the second wastewater outlet.

8. The handheld window cleaning machine having the wastewater separation structure according to claim 7, wherein a water entry passage is isolated from a lower portion of the auxiliary water tank, the wastewater backflow openings are arranged at a bottom of the auxiliary water tank, the water entry passage is in communication with the auxiliary water tank through the wastewater backflow openings, the suction nozzle joint is in communication with the water entry passage through a suction nozzle elbow pipe, the front end of the water inlet pipe is in communication with the water entry passage, after being sucked by the suction head assembly, wastewater flows into the tank through the suction nozzle joint, the suction nozzle elbow pipe, the water entry passage and the water inlet pipe in sequence.

9. The handheld window cleaning machine having the wastewater separation structure according to claim 8, wherein an air-out connecting port in communication with the fan chamber is arranged behind the motor cover plate, the front end of the air-out pipe is in communication with the air-out connecting port through the air evacuation opening, the front end of the water inlet pipe is in communication with the water entry passage through the water inlet, the centrifugal fan is configured to throw a water-air mixture outputted from the air-out pipe onto a side wall of the fan chamber.

* * * * *